US010767911B2

(12) United States Patent
Zha

(10) Patent No.: US 10,767,911 B2
(45) Date of Patent: Sep. 8, 2020

(54) COOLING SYSTEM

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 144 days.

(21) Appl. No.: 15/819,090

(22) Filed: Nov. 21, 2017

(65) Prior Publication Data

US 2019/0154317 A1 May 23, 2019

(51) Int. Cl.

| | |
|---|---|
| ***F25B 41/00*** | (2006.01) |
| ***F25B 1/10*** | (2006.01) |
| ***F25B 40/00*** | (2006.01) |
| ***F25B 43/02*** | (2006.01) |
| ***F25D 11/02*** | (2006.01) |

(52) U.S. Cl.

CPC ..... *F25B 41/00* (2013.01); *F25B 1/10* (2013.01); *F25B 40/00* (2013.01); *F25B 43/02* (2013.01); *F25D 11/02* (2013.01); *F25B 2339/02* (2013.01); *F25B 2400/13* (2013.01); *F25B 2400/23* (2013.01)

(58) Field of Classification Search

CPC .. F25B 41/00; F25B 1/10; F25B 40/00; F25B 2339/02; F25B 2400/13; F25B 2400/23; F25B 2400/075; F25B 5/00; F25B 5/02; F25B 5/04; F25B 43/006; F25B 2347/02; F25B 2347/021

See application file for complete search history.

(56) References Cited

U.S. PATENT DOCUMENTS

| | | | | |
|---|---|---|---|---|
| 2010/0031697 | A1* | 2/2010 | Hinde | F25B 7/00 62/498 |
| 2011/0023514 | A1* | 2/2011 | Mitra | F25B 1/10 62/222 |
| 2011/0036110 | A1* | 2/2011 | Fujimoto | F24D 3/18 62/149 |
| 2017/0159977 | A1* | 6/2017 | Hellmann | F25B 1/10 |

FOREIGN PATENT DOCUMENTS

| | | | |
|---|---|---|---|
| EP | 2317251 | A1 * | 4/2011 |
| EP | 2 317 251 | A1 | 5/2011 |
| EP | 3 196 568 | A1 | 7/2017 |
| WO | WO 2008/140454 | A1 | 11/2008 |

OTHER PUBLICATIONS

Extended European Search Report from EPO Patent Office, Application No. 18204083.2-1008; Ref: DHP97503P.EPP, dated Apr. 3, 2019.

* cited by examiner

*Primary Examiner* — Elizabeth J Martin
(74) *Attorney, Agent, or Firm* — Baker Botts L.L.P.

(57) ABSTRACT

An apparatus includes a flash tank, a load, a first compressor, a heat exchanger, and a second compressor. The flash tank stores a refrigerant and releases the refrigerant as a flash gas. The load uses the refrigerant to remove heat from a space proximate the load. The first compressor compresses the refrigerant from the load and directs the refrigerant to the flash tank. The heat exchanger transfers heat from the refrigerant from a high side heat exchanger to the refrigerant released from the flash tank as the flash gas. The second compressor compresses the refrigerant released from the flash tank as the flash gas.

14 Claims, 4 Drawing Sheets

COOLING SYSTEM

TECHNICAL FIELD

This disclosure relates generally to a cooling system, such as a refrigeration system.

BACKGROUND

Cooling systems are used to cool spaces, such as residential dwellings, commercial buildings, and/or refrigeration units. These systems cycle a refrigerant (also referred to as charge) that is used to cool the spaces.

SUMMARY OF THE DISCLOSURE

This disclosure contemplates an unconventional cooling system that efficiently handles refrigerant from a low temperature load when a medium temperature load is not in use. The system directs refrigerant from the discharge of a low temperature compressor to a flash tank instead of to a suction of a medium temperature compressor. The refrigerant then mixes with the refrigerant in the flash tank. The flash tank discharges liquid refrigerant back to the low temperature load and gaseous refrigerant (also referred to as a flash gas) to a parallel compressor. On its way to the parallel compressor, a heat exchanger may transfer heat from a refrigerant from a high side heat exchanger to the flash gas. Certain embodiments will be described below.

According to an embodiment, an apparatus includes a flash tank, a load, a first compressor, a heat exchanger, and a second compressor. The flash tank stores a refrigerant and releases the refrigerant as a flash gas. The load uses the refrigerant to remove heat from a space proximate the load. The first compressor compresses the refrigerant from the load and directs the refrigerant to the flash tank. The heat exchanger transfers heat from the refrigerant from a high side heat exchanger to the refrigerant released from the flash tank as the flash gas. The second compressor compresses the refrigerant released from the flash tank as the flash gas.

According to another embodiment, a method includes storing a refrigerant in a flash tank and releasing the refrigerant from the flash tank as a flash gas. The method also includes using the refrigerant to remove heat from a space proximate a load and compressing, using a first compressor, the refrigerant from the load. The method further includes directing the refrigerant from the first compressor to the flash tank and transferring, using a heat exchanger, heat from the refrigerant from a high side heat exchanger to the refrigerant released from the flash tank as the flash gas. The method also includes compressing, using a second compressor, the refrigerant released from the flash tank as the flash gas.

According to yet another embodiment, a system includes a high side heat exchanger, a flash tank, a load, a first compressor, a heat exchanger, and a second compressor. The high side heat exchanger removes heat from a refrigerant. The flash tank stores the refrigerant and releases the refrigerant as a flash gas. The load uses the refrigerant to remove heat from a space proximate the load. The first compressor compresses the refrigerant from the load and directs the refrigerant to the flash tank. The heat exchanger transfers heat from the refrigerant from the high side heat exchanger to the refrigerant released from the flash tank as the flash gas. The second compressor compresses the refrigerant released from the flash tank as the flash gas.

Certain embodiments provide one or more technical advantages. For example, an embodiment operates a low temperature load and no medium temperature load without needing a desuperheater, thus reducing cost and space requirements. Additionally, the embodiment improves efficiency by operating a low temperature compressor and a parallel compressor. As another example, an embodiment may further improve efficiency by including an optional desuperheater at a low temperature compressor discharge. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1A:
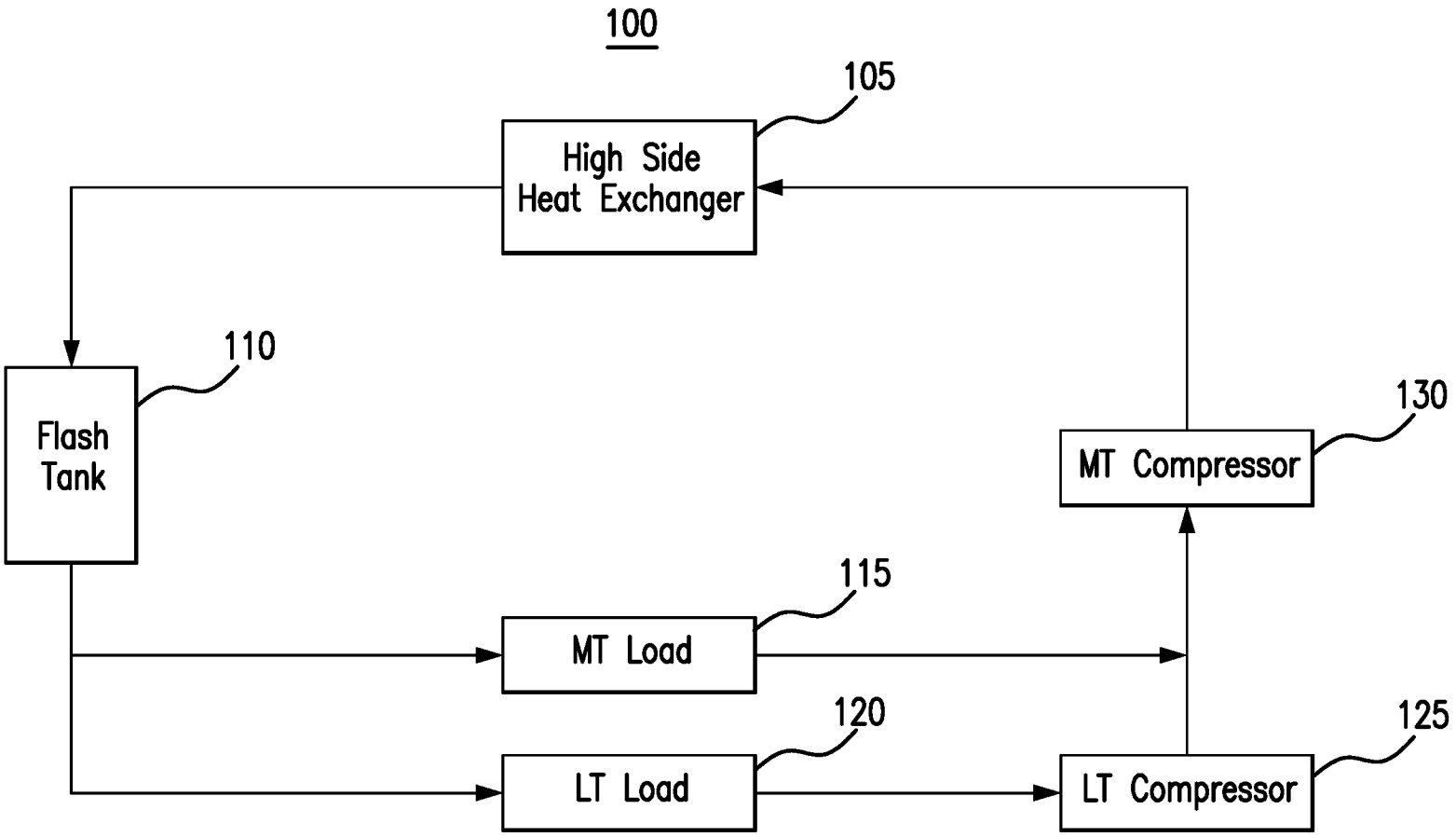
FIGS. 1A-1B illustrate portions of an example cooling system.
Figure 1B:
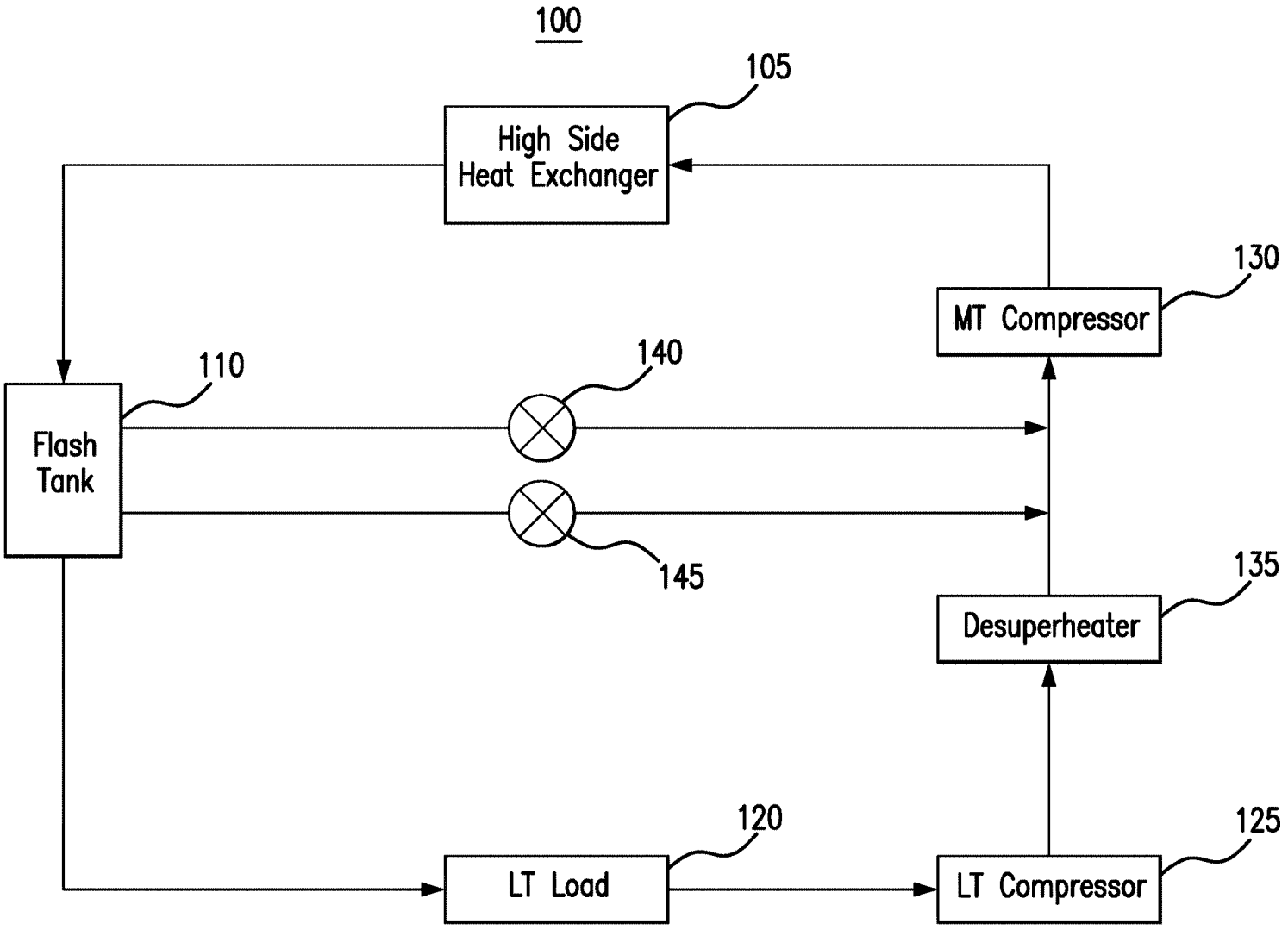
Figure 2:
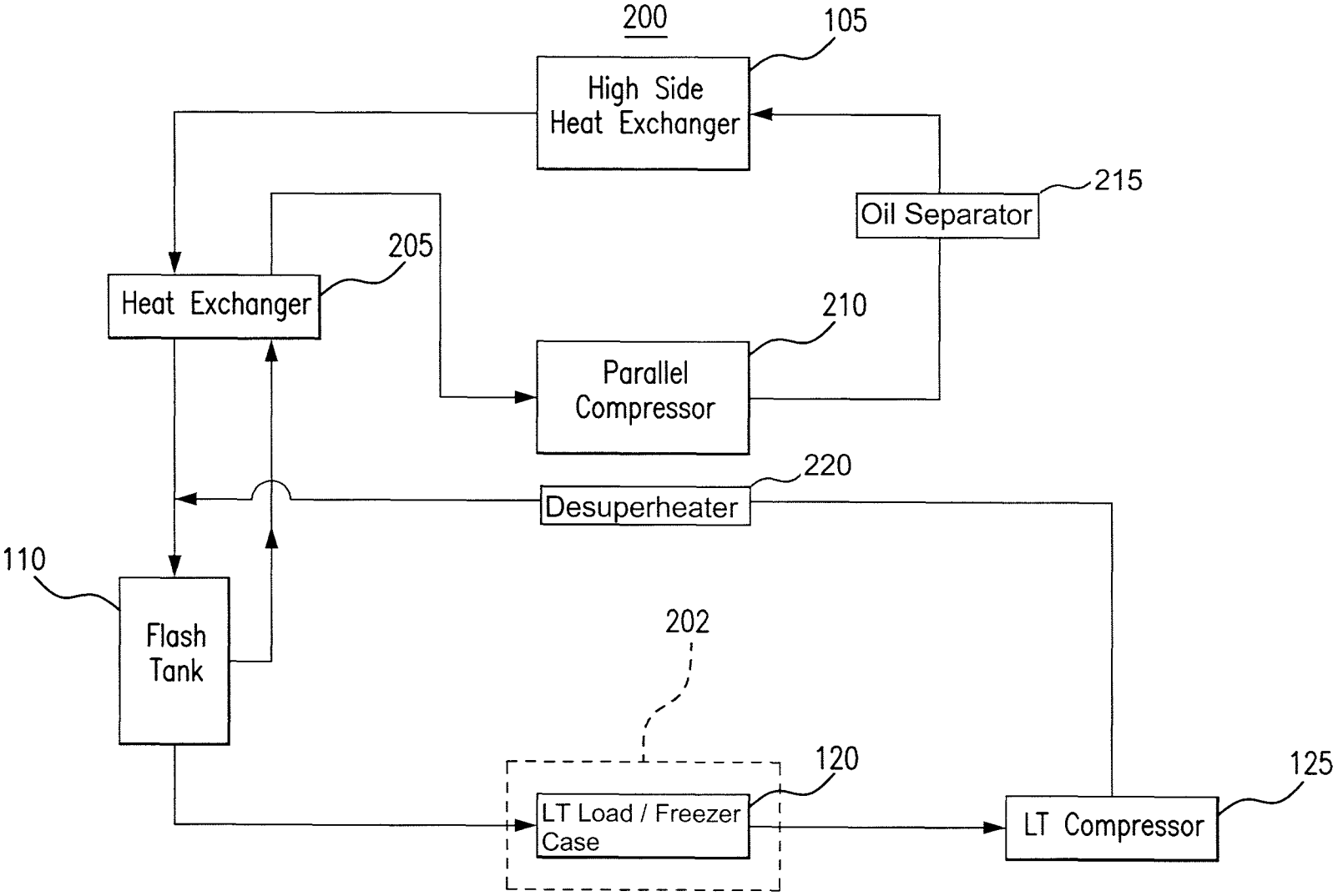
FIG. 2 illustrates portions of an example cooling system.
Figure 3:
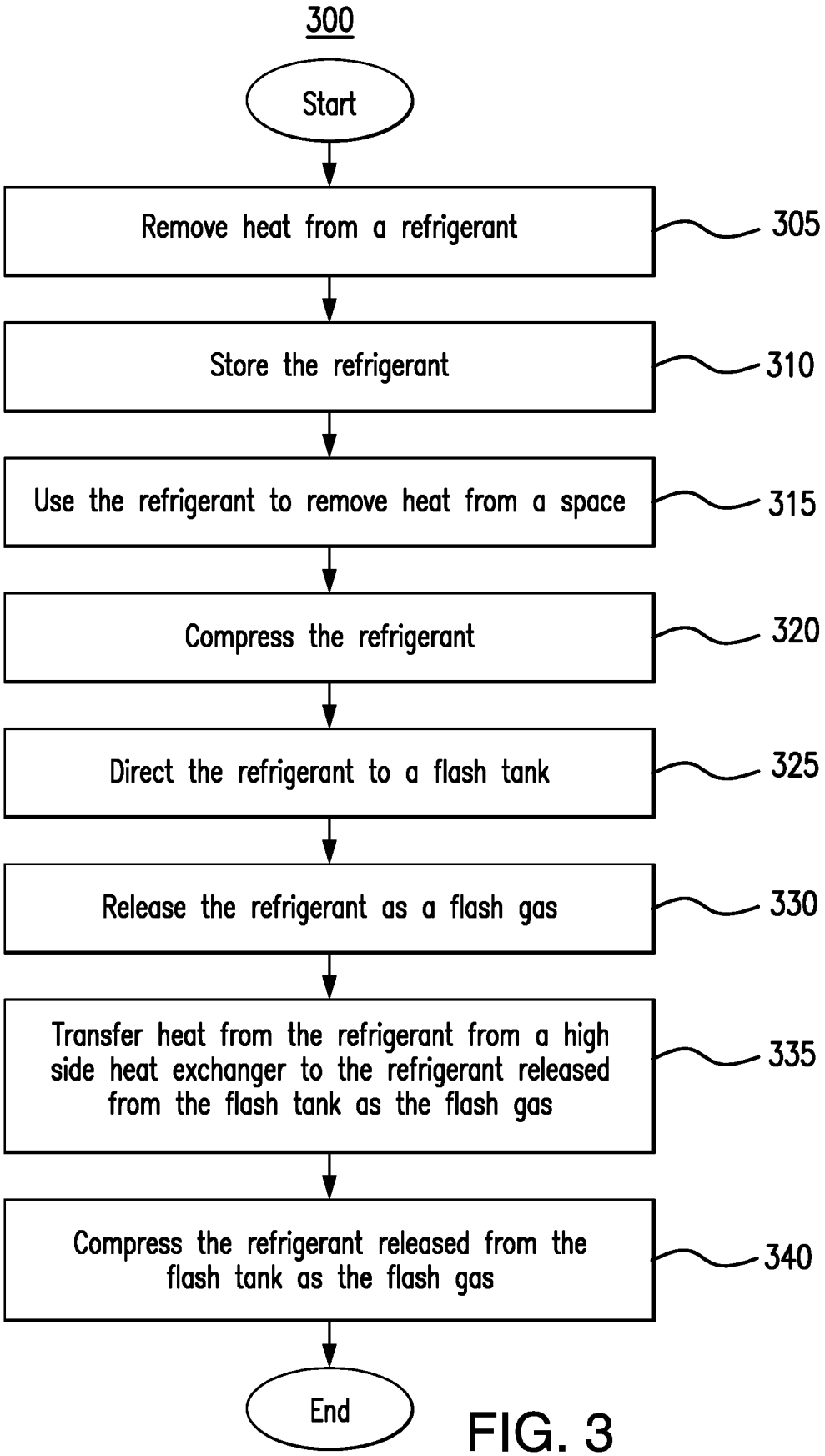
FIG. 3 is a flowchart illustrating a method for operating the cooling system of FIG. 2.

Embodiments of the present disclosure and its advantages are best understood by referring to FIGS. 1 through 3 of the drawings, like numerals being used for like and corresponding parts of the various drawings.

Cooling systems are used to cool spaces, such as residential dwellings, commercial buildings, and/or refrigeration units. These systems cycle a refrigerant (also referred to as charge) that is used to cool the spaces. In existing refrigeration systems, such as ones in grocery stores, refrigerant is cycled through various cooling cases to keep food cold. Generally, these refrigeration systems use two types of loads known as medium temperature loads and low temperature loads. The medium temperature loads may be produce shelves that keep a space cooled above freezing temperatures (e.g., above 32 degrees Fahrenheit), and the low temperature loads may be freezer cases that keep a space cooled below freezing temperatures (e.g., at or below 32 degrees Fahrenheit).

Refrigerant from these two types of loads are directed to their respective compressors (e.g., a low temperature compressor and a medium temperature compressor). The discharge from the low temperature compressor is then directed to the medium temperature compressor. The refrigerant from the medium temperature load mixes with and cools the refrigerant from the low temperature compressor before the mixture enters the medium temperature compressor.

In some installations however (such as those shown in FIGS. 1A and 1B), the medium temperature loads are sometimes shut off and/or removed from the system. When that happens, the medium temperature compressor may not operate appropriately or efficiently due to the absence of the refrigerant from the medium temperature load, which causes the refrigerant entering the medium temperature compressor being too hot or too high pressure. To protect against the medium temperature compressor malfunctioning, additional piping and equipment (e.g., a desuperheater) is added to the system to cool the refrigerant entering the medium temperature compressor. This additional piping and equipment increase the cost of the system as well as the space requirements for installing the system.

This disclosure contemplates an unconventional cooling system that efficiently handles refrigerant from a low temperature load when a medium temperature load is not in use. The system directs refrigerant from the discharge of a low temperature compressor to a flash tank instead of to a suction of a medium temperature compressor. The refrigerant then mixes with the refrigerant in the flash tank. The flash tank discharges liquid refrigerant back to the low temperature load and gaseous refrigerant (also referred to as a flash gas) to a parallel compressor. On its way to the parallel compressor, a heat exchanger may transfer heat from a refrigerant from a high side heat exchanger to the flash gas. The cooling system will be described in more detail using FIGS. 2 and 3.

FIG. 1A illustrates portions of an example cooling system 100, such as one found in a grocery store. As seen in FIG. 1A, system 100 includes a high side heat exchanger 105, a flash tank 110, a medium temperature load 115, a low temperature load 120, a low temperature compressor 125, and a medium temperature compressor 130.

High side heat exchanger 105 may remove heat from a refrigerant. When heat is removed from the refrigerant, the refrigerant is cooled. This disclosure contemplates high side heat exchanger 105 being operated as a condenser, a fluid cooler, and/or a gas cooler. When operating as a condenser, high side heat exchanger 105 cools the refrigerant such that the state of the refrigerant changes from a gas to a liquid. When operating as a fluid cooler, high side heat exchanger 105 cools liquid refrigerant and the refrigerant remains a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Flash tank 110 may store refrigerant received from high side heat exchanger 105. This disclosure contemplates flash tank 110 storing refrigerant in any state such as, for example, a liquid state and/or a gaseous state. Refrigerant leaving flash tank 110 is fed to low temperature load 120 and medium temperature load 115. In some embodiments, a flash gas and/or a gaseous refrigerant is released from flash tank 110. By releasing flash gas, the pressure within flash tank 110 may be reduced.

System 100 may include a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. As seen in FIG. 1A, system 100 includes a medium temperature load 115 and a low temperature load 120. Each of these loads is used to cool a particular space. For example, medium temperature load 115 may be a produce shelf in a grocery store and low temperature load 120 may be a freezer case. Generally, low temperature load 120 keeps a space cooled to freezing temperatures (e.g., below 32 degrees Fahrenheit) and medium temperature load 115 keeps a space cooled above freezing temperatures (e.g., above 32 degrees Fahrenheit).

Refrigerant may flow from flash tank 110 to both the low temperature and medium temperature portions of the refrigeration system. For example, the refrigerant may flow to low temperature load 120 and medium temperature load 115. When the refrigerant reaches low temperature load 120 or medium temperature load 115, the refrigerant removes heat from the air around low temperature load 120 or medium temperature load 115. As a result, the air is cooled. The cooled air may then be circulated such as, for example, by a fan to cool a space such as, for example, a freezer and/or a refrigerated shelf. As refrigerant passes through low temperature load 120 and medium temperature load 115, the refrigerant may change from a liquid state to a gaseous state as it absorbs heat.

Refrigerant may flow from low temperature load 120 and medium temperature load 115 to compressors 125 and 130. This disclosure contemplates system 100 including any number of low temperature compressors 125 and medium temperature compressors 130. The low temperature compressor 125 and medium temperature compressor 130 may be configured to increase the pressure of the refrigerant. As a result, the heat in the refrigerant may become concentrated and the refrigerant may become a high pressure gas. Low temperature compressor 125 may compress refrigerant from low temperature load 120 and send the compressed refrigerant to medium temperature compressor 130. Medium temperature compressor 130 may compress refrigerant from low temperature compressor 125 and medium temperature load 115. The refrigerant from low temperature compressor 125 mixes with and is cooled by the refrigerant from medium temperature load 115 before entering medium temperature compressor 130. Medium temperature compressor 130 may then send the compressed refrigerant to high side heat exchanger 105.

In some installations, medium temperature load 115 is sometimes shut down and/or removed from system 100. As a result, the refrigerant from low temperature compressor 125 is not cooled by the refrigerant from medium temperature load 115 before it enters medium temperature compressor 130. Thus, the refrigerant entering medium temperature compressor 130 may be too hot, which may cause medium temperature compressor 130 to operate inefficiently and/or malfunction. In these instances, to protect medium temperature compressor 130, additional piping and/or equipment is added to system 100 to cool the refrigerant from low temperature compressor 125. This additional piping and equipment increases both the cost of system 100 and the space occupied by system 100.

FIG. 1B illustrates system 100 with medium temperature load 115 removed and additional piping and/or equipment installed. As seen in FIG. 1B, system 100 includes a desuperheater 135, a flash gas bypass valve 140 controlling a flash gas bypass line, and a liquid injection valve 145 controlling a liquid injection line. Each of these additional components operate to cool the refrigerant from low temperature compressor 125 before it enters medium temperature compressor 130. Each of these components increase the cost of system 100 and the space occupied by system 100.

Desuperheater 135 operates similarly to a heatsink. Desuperheater 135 absorbs heat from the refrigerant from low temperature compressor 125 and discharges that absorbed heat away from system 100, for example into the atmosphere. Desuperheater 135 may include metallic components that transfer and/or conduct heat away from the refrigerant from low temperature compressor 125. Desuperheater 135 may include a fan that circulates air to expel heat absorbed from the refrigerant from low temperature compressor 125. In this manner, desuperheater 135 cools the refrigerant from low temperature compressor 125.

The flash gas bypass line and the liquid injection line direct cool refrigerant from flash tank 110 to mix with the refrigerant from low temperature compressor 125 before it enters medium temperature compressor 130. The flash gas bypass line directs flash gas (e.g., refrigerant in a gaseous state) from flash tank 110 to mix with the refrigerant from low temperature compressor 125. The liquid injection line directs liquid refrigerant from flash tank 110 to mix with the refrigerant from low temperature compressor 125. Both lines operate to cool the refrigerant from low temperature compressor 125.

Flash gas bypass valve 140 and liquid injection valve 145 control the flow of refrigerant through the flash gas bypass line and the liquid injection line respectively. System 100 may include a controller that opens and closes flash gas bypass valve 140 based on a pressure of the refrigerant in flash tank 110 and opens and closes liquid injection valve 145 based on a temperature of the refrigerant at the suction of medium temperature compressor 130. For example, if the pressure of the refrigerant in flash tank 110 is too high, the controller may open flash gas bypass valve 140 to direct flash gas to mix with the refrigerant from low temperature compressor 125. If the refrigerant at the suction of medium temperature compressor 130 is too hot, then the controller may open liquid injection valve 145 to direct liquid refrigerant from flash tank 110 to mix with the refrigerant from low temperature compressor 125.

FIG. 2 illustrates portions of an example cooling system 200. As shown in FIG. 2, system 200 includes a high side heat exchanger 105, a flash tank 110, a low temperature load 120, a low temperature compressor 125, a heat exchanger 205, and a parallel compressor 210. In particular embodiments, system 200 reduces costs by eliminating the additional piping and/or equipment present in cooling system 100. In some embodiments, system 200 takes up less space than system 100 by eliminating certain piping and equipment.

High side heat exchanger 105, flash tank 110, low temperature load 120, and low temperature compressor 125 operate similarly to these components in system 100. For example, high side heat exchange 105 removes heat from a refrigerant. Flash tank 110 stores the refrigerant as both a liquid and a flash gas. Flash tank 110 releases liquid refrigerant to low temperature load 120 and releases flash gas to heat exchanger 205. Low temperature load 120 uses the refrigerant to remove heat from a space 202 proximate low temperature load 120. Low temperature compressor 125 compresses the refrigerant from low temperature load 120.

System 200 eliminates certain piping and equipment from system 100 by reconfiguring the discharge of low temperature compressor 125 and flash tank 110. As illustrated in FIG. 2, low temperature compressor 125 directs compressed refrigerant to flash tank 110. The refrigerant then mixes and is cooled by the refrigerant in flash tank 110. The discharge of flash gas from flash tank 110 is directed through heat exchanger 205 to parallel compressor 210 and then to high side heat exchanger 105.

Heat exchanger 205 transfers heat from the refrigerant from high side heat exchanger 105 to the flash gas discharged by flash tank 110. Heat exchanger 205 may include any heat conducting surfaces such as plates, fins, and/or tubes. As heat exchanger 205 transfers heat from the refrigerant from high side heat exchanger 105 to the flash gas from flash tank 110, the refrigerant from high side heat exchanger 105 is cooled and the flash gas is heated. In this manner, the efficiency of system 200 is improved because more liquid refrigerant enters flash tank 110 from heat exchanger 205. Additionally, the flash gas from flash tank 110 is heated sufficiently so that parallel compressor 210 may efficiently compress the flash gas.

Parallel compressor 210 receives the flash gas from heat exchanger 205 and compresses the flash gas. By compressing the flash gas, parallel compressor 210 concentrates the heat within the flash gas. Parallel compressor 210 then directs the compressed flash gas to high side heat exchanger 105. High side heat exchanger 105 may then remove the concentrated heat from the compressed flash gas. Though this disclosure describes heat exchanger 205, parallel compressor 210, and high side heat exchanger 105 operating on a flash gas, it is understood that the flash gas is a term for the refrigerant when it is in a gaseous state.

In this manner, system 200 is able to operate efficiently and safely without a medium temperature load, a desuperheater, a flash gas bypass line, and a liquid injection line.

In particular embodiments, system 200 includes an oil separator 215 between parallel compressor 210 and high side heat exchanger 105. The oil separator 215 operates to separate an oil from the refrigerant before the refrigerant enters high side heat exchanger 105. The oil may be introduced by certain components of parallel compressor 210 and/or low temperature compressor 125. By separating out the oil, the efficiency of high side heat exchanger 105 is maintained. If the oil separator 215 is not present, then the oil may clog high side heat exchanger 105 and load 120, which may reduce the heat transfer efficiency of system 200, high side heat exchanger 105, and/or load 120.

In some embodiments, a desuperheater 220 may be added between low temperature compressor 125 and flash tank 110. The desuperheater 220 may cool the refrigerant from low temperature compressor 125 before it enters flash tank 110. This desuperheater 220 may reduce the energy consumption of system 200 by about 2% to 5%.

FIG. 3 is a flow chart illustrating a method 300 for operating cooling system 200 in FIG. 2. In particular embodiments, the various components of system 200 perform method 300. By performing method 300, system 200 may operate efficiently and safely even though a medium temperature load, a desuperheater, a flash gas bypass line, and a liquid injection line are eliminated.

A high side heat exchanger may remove heat from a refrigerant in step 305. A flash tank stores the refrigerant in step 310. In step 315, a load such as a low temperature load uses the refrigerant to remove heat from a space. A compressor such as a low temperature compressor then compresses the refrigerant in step 320.

The compressor can direct the refrigerant to a flash tank in step 325. In step 330, the flash tank releases the refrigerant as a flash gas. The flash gas is then directed to a heat exchanger that transfers heat from the refrigerant from a high side heat exchanger to the refrigerant released from the flash tank as the flash gas in step 335. The heat exchanger then directs the refrigerant to a parallel compressor that compresses the refrigerant released from the flash tank as the flash gas in step 340. In this manner, the refrigerant from the low temperature compressor mixes and is cooled by the refrigerant in the flash tank. The heated refrigerant in the flash tank can then be discharged to a parallel compressor to be compressed before being directed to the high side heat exchanger.

Modifications, additions, or omissions may be made to method 300 depicted in FIG. 3. Method 300 may include more, fewer, or other steps. For example, steps may be performed in parallel or in any suitable order. While discussed as system 100 (or components thereof) performing the steps, any suitable component of system 100 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a flash tank that stores a refrigerant and to release the refrigerant as a flash gas;

a freezer that receives the refrigerant from the flash tank such that the refrigerant from the flash tank removes heat from a space proximate the freezer when the refrigerant from the flash tank is in the freezer;

a first compressor that compresses the refrigerant from the freezer and directs the refrigerant to the flash tank before the refrigerant reaches a second compressor;

a desuperheater that removes heat from the refrigerant compressed by the first compressor before the refrigerant from the first compressor reaches the flash tank;

a heat exchanger that transfers heat from the refrigerant from a high side heat exchanger to the refrigerant released from the flash tank as the flash gas; and the second compressor compresses the refrigerant released from the flash tank as the flash gas.

2. The apparatus of claim 1, further comprising an oil separator configured to separate an oil from the refrigerant compressed by the second compressor and to direct the refrigerant to the high side heat exchanger.

3. The apparatus of claim 1, wherein the flash tank is further configured to release the refrigerant as a liquid to the freezer.

4. The apparatus of claim 1 not comprising a load configured to cool a space to a temperature above 32 degrees Fahrenheit.

5. The apparatus of claim 1, wherein the high side heat exchanger is configured to operate as a gas cooler.

6. A method comprising:

storing a refrigerant in a flash tank;

releasing the refrigerant from the flash tank as a flash gas;

receiving, at a freezer, the refrigerant from the flash tank such that the refrigerant from the flash tank removes heat from a space proximate the freezer when the refrigerant from the flash tank is in the load;

compressing, using a first compressor, the refrigerant from the freezer;

directing the refrigerant from the first compressor to the flash tank before the refrigerant reaches a second compressor;

removing, using a desuperheater, heat from the refrigerant compressed by the first compressor before the refrigerant from the first compressor reaches the flash tank;

transferring, using a heat exchanger, heat from the refrigerant from a high side heat exchanger to the refrigerant released from the flash tank as the flash gas; and compressing, using the compressor, the refrigerant released from the flash tank as the flash gas.

7. The method of claim 6, further comprising:

separating, using an oil separator, an oil from the refrigerant compressed by the second compressor; and directing the refrigerant from the oil separator to the high side heat exchanger.

8. The method of claim 6, further comprising releasing the refrigerant from the flash tank as a liquid to the freezer.

9. The method of claim 6, wherein the high side heat exchanger is configured to operate as a gas cooler.

10. A system comprising:

a high side heat exchanger that removes heat from a refrigerant;

a flash tank that stores the refrigerant and to release the refrigerant as a flash gas;

a freezer that receives the refrigerant from the flash tank such that the refrigerant from the flash tank removes heat from a space proximate the freezer when the refrigerant from the flash tank is in the freezer;

a first compressor that compresses the refrigerant from the freezer and to direct the refrigerant to the flash tank before the refrigerant reaches a second compressor;

a desuperheater that removes heat from the refrigerant compressed by the first compressor before the refrigerant from the first compressor reaches the flash tank;

a heat exchanger that transfers heat from the refrigerant from the high side heat exchanger to the refrigerant released from the flash tank as the flash gas; and the second compressor compresses the refrigerant released from the flash tank as the flash gas.

11. The system of claim 10, further comprising an oil separator configured to separate an oil from the refrigerant compressed by the second compressor and to direct the refrigerant to the high side heat exchanger.

12. The system of claim 10, wherein the flash tank is further configured to release the refrigerant as a liquid to the freezer.

13. The system of claim 10 not comprising a load configured to cool a space to a temperature above 32 degrees Fahrenheit.

14. The system of claim 10, wherein the high side heat exchanger is configured to operate as a gas cooler.

* * * * *